US012053710B1

(12) United States Patent
Benton

(10) Patent No.: US 12,053,710 B1
(45) Date of Patent: Aug. 6, 2024

(54) INTERACTIVE DOLL

(71) Applicant: Markita Benton, Brooklyn, NY (US)

(72) Inventor: Markita Benton, Brooklyn, NY (US)

( * ) Notice: Subject to any disclaimer, the term of this patent is extended or adjusted under 35 U.S.C. 154(b) by 240 days.

(21) Appl. No.: 17/679,722

(22) Filed: Feb. 24, 2022

(51) Int. Cl.

| | |
|---|---|
| ***A63H 3/12*** | (2006.01) |
| ***A63H 3/28*** | (2006.01) |
| ***A63H 3/36*** | (2006.01) |
| ***A63H 13/00*** | (2006.01) |

(52) U.S. Cl.
CPC ..... *A63H 13/005* (2013.01); *A63H 3/12* (2013.01); *A63H 3/28* (2013.01); *A63H 3/365* (2013.01); *A63H 2200/00* (2013.01)

(58) Field of Classification Search
CPC . A63H 3/12; A63H 3/28; A63H 3/365; A63H 13/00; A63H 13/005
See application file for complete search history.

(56) References Cited

U.S. PATENT DOCUMENTS

| | | | | |
|---|---|---|---|---|
| 3,729,865 | A | 5/1973 | Naunheim | |
| 3,755,960 | A | 9/1973 | Tepper et al. | |
| 6,554,679 | B1 * | 4/2003 | Shackelford | A63H 3/28 446/268 |
| 6,585,556 | B2 * | 7/2003 | Smirnov | A63H 3/28 446/175 |
| 10,421,027 | B2 * | 9/2019 | Sufer | A63H 13/02 |
| 2007/0128979 | A1 * | 6/2007 | Shackelford | A63H 3/365 446/484 |
| 2007/0254554 | A1 * | 11/2007 | Ellman | A63H 3/365 446/337 |
| 2009/0053971 | A1 * | 2/2009 | Hui | A63H 3/36 446/295 |

* cited by examiner

*Primary Examiner* — John A Ricci
(74) *Attorney, Agent, or Firm* — Sanchelima & Associates, P.A.; Christian Sanchelima; Jesus Sanchelima

(57) ABSTRACT

An interactive doll including a doll assembly and an electrical assembly. The doll assembly further includes an interactive doll in the shape of a human figure, the interactive doll has touch sensitive zones that permit a user to perform predetermined actions when those zones are touched. The electrical assembly includes sensors, a speaker and a microprocessor. The sensors are located inside predetermined locations of the interactive doll, each of the sensors send an input signal to the microprocessor. Depending on the signal that the input signals, the microprocessor activates predetermined actions such as conveying predetermined audible messages, wherein the audible messages can be conveyed in different languages. The interactive doll is perfect for kids with autism as it helps them to develop social skills and motor skills.

18 Claims, 6 Drawing Sheets

INTERACTIVE DOLL

II. BACKGROUND OF THE INVENTION

1. Field of the Invention

The present invention relates to an interactive doll and, more particularly, to an interactive doll that helps kids with autism to develop social skills as well as motion skills.

2. Description of the Related Art

Several designs for dolls have been designed in the past. None of them, however, include sensors located at predetermined zones inside the interactive doll. Each of the sensors are used to detect a touch from the user. When a touch is detected the sensors send different actuation signals for the interactive doll to perform predetermined tasks, such as convey an audible message, turn the face of the doll into a mirror, or rise the arms for the user to embrace the doll.

Applicant believes that a related reference corresponds to U.S. Pat. No. 3,755,960 issued for an interactive speaking doll with integral electronics and a computer control for operating and changing facial expressions. Applicant believes that another related reference corresponds to U.S. Pat. No. 3,729,865 issued for a plush toy doll with a mirrored face. None of these references, however, teach of an interactive toy doll in the shape of a human figure wherein the doll has touch sensitive zones which activate various speech outputs, an electronic digital face which be changed into a mirror to reflect the child's face back to them, and a language selector for changing the speech output on the doll.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a unique doll for children with autism.

It is another object of this invention to provide a doll which is interactive, colorful, and motivational.

It is still another object of the present invention to provide an interactive doll that helps to enhance communication and language skills.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
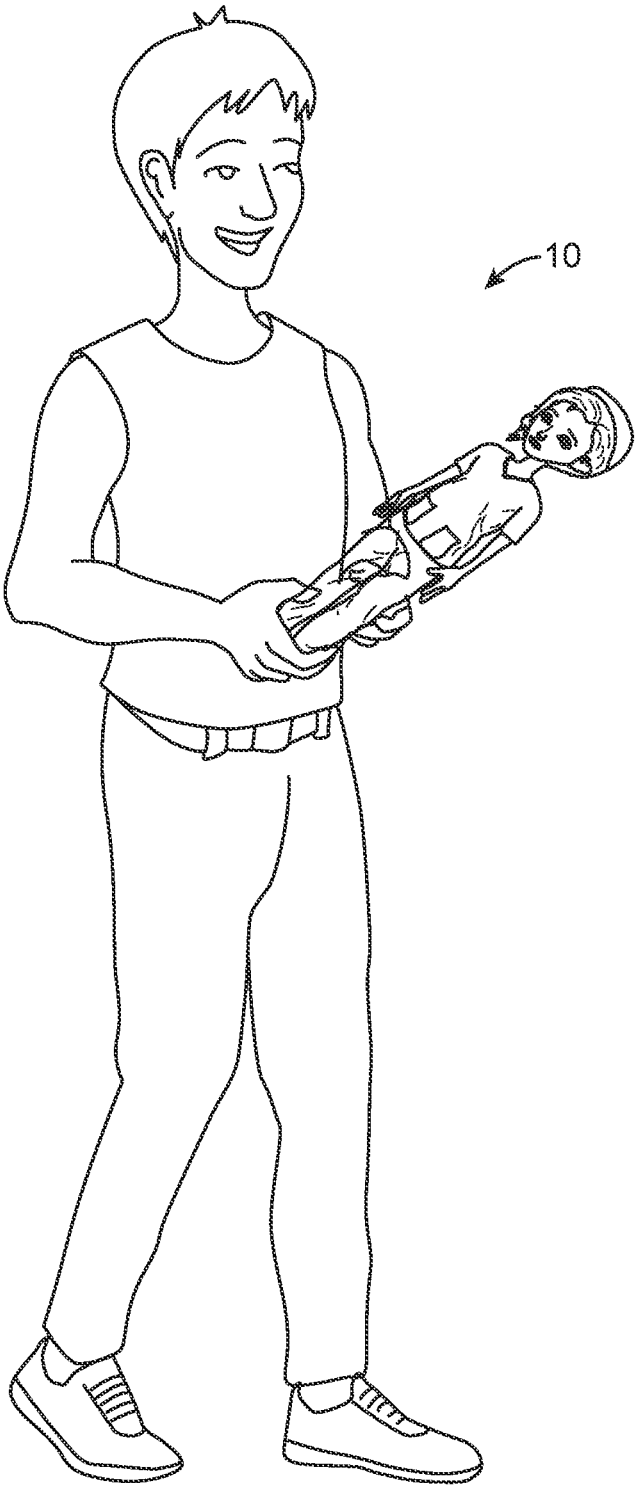

With the above and other related objects in view, the invention consists in the details of construction and combination of parts as will be more fully understood from the following description, when read in conjunction with the accompanying drawings in which:

FIG. 1 represents an operational view of a user playing with the interactive doll 10.

Figure 2:
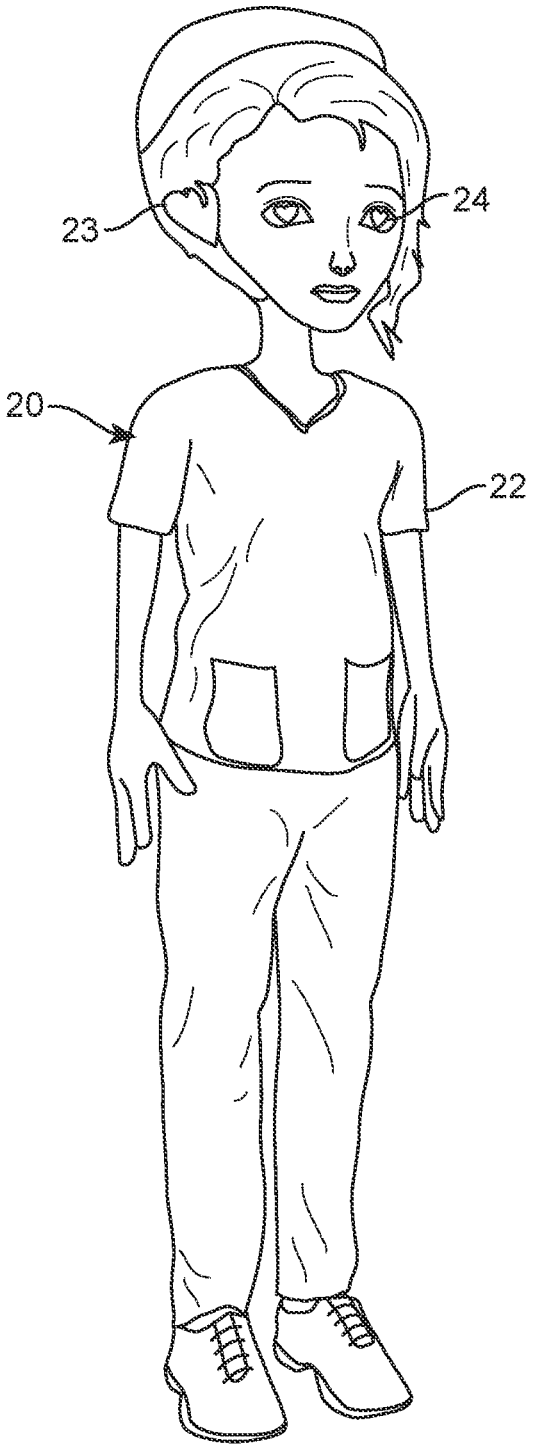

FIG. 2 shows an isometric view of the doll assembly 20 including an interactive doll 22. The interactive doll 22 has ears 23 and eyes 24 that are heart shaped.

Figure 3:
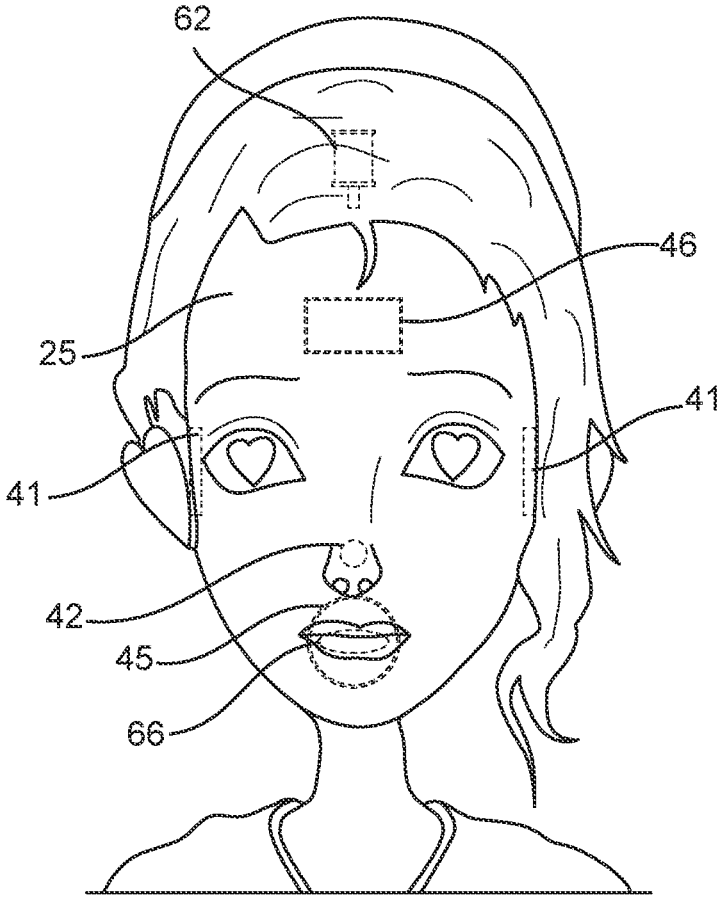

FIG. 3 illustrates an enlarged internal view of the face 25 of the interactive doll 22. It is shown the ear sensors 41, the nose sensor 42, the microprocessor 46, the speaker 45, and the rotation mechanism 62.

Figure 4:
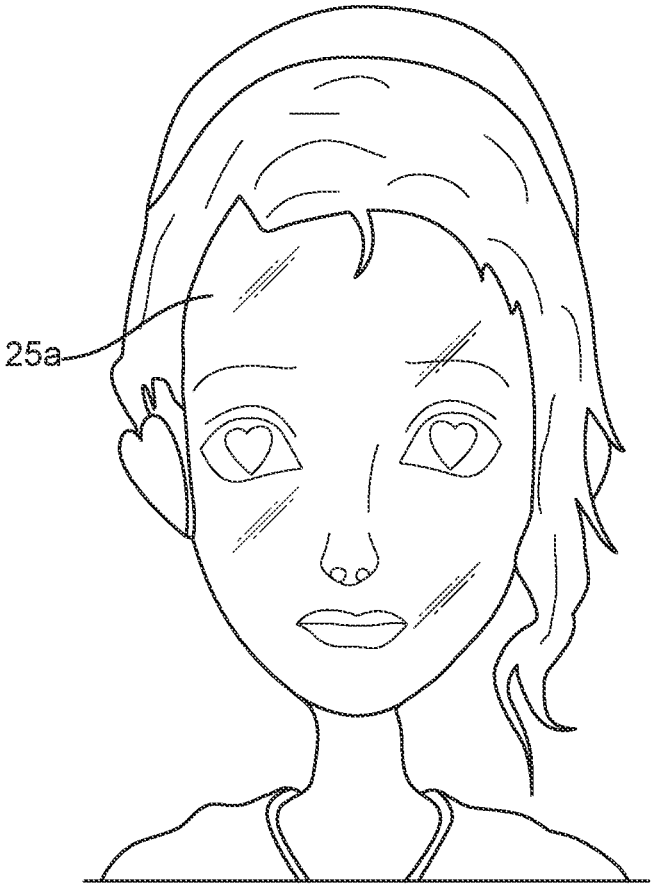

FIG. 4 is a representation of an enlarged view of the mirror face 25*a* of the interactive doll 22.

Figure 5:
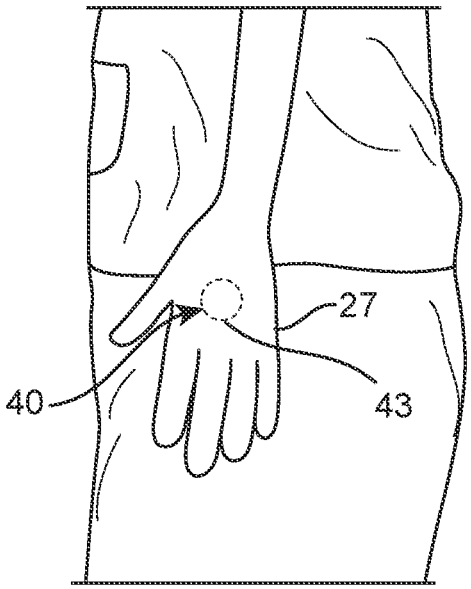

FIG. 5 shows an enlarged internal view of the hands 27 showing the hands sensor 43 from the electrical assembly 40. The hand sensors 43 actuate a predetermined feature of the interactive doll 22.

Figure 6:
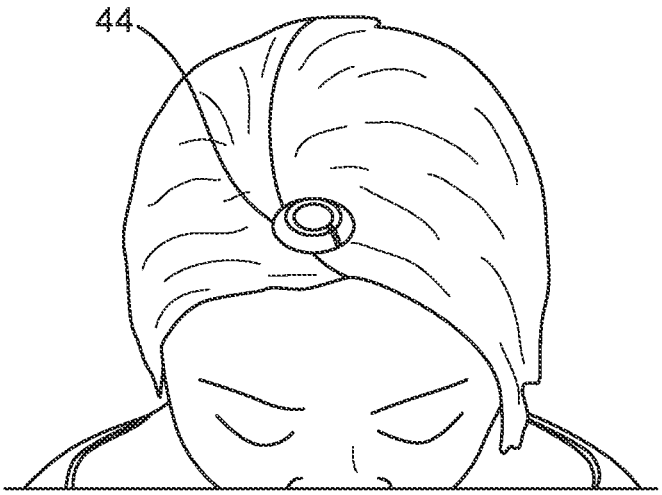

FIG. 6 illustrates an enlarged view of the top of the head of the doll showing the selector switch 44.

Figure 7:
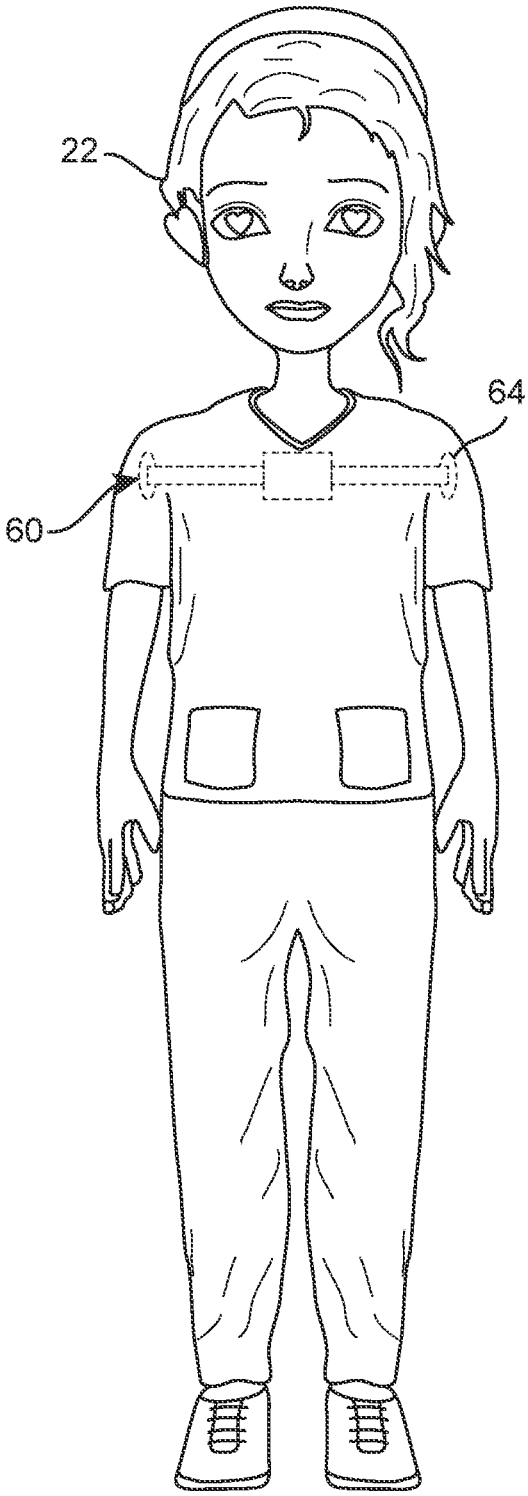

FIG. 7 depicts an internal front view of the interactive doll 22 showing the hug mechanism 64 from the actuation assembly 60.

V. DETAILED DESCRIPTION OF THE EMBODIMENTS OF THE INVENTION

Referring now to the drawings, where the present invention is generally referred to with numeral 10, it can be observed that it basically includes a doll assembly 20, an electrical assembly 40, and an actuation mechanism 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The doll assembly 20 includes an interactive doll 22. The interactive doll 22 may be volumetrically suitable to allow a child to play with it. In a suitable embodiment said interactive doll 22 may be made of a resistant and durable material. Interactive doll 22 may be made of acrylic, polycarbonate, polyethylene, polypropylene, polyethylene terephthalate, polyvinyl chloride, acrylonitrile-butadiene-styrene, wood, metal, cloth, fabrics, fibers, ceramics, or any variation or combination thereof. The interactive doll 22 may have a shape that resembles the shape of a human. In a suitable embodiment, the interactive doll 22 may be dressed as a nurse. Nonetheless, in other embodiments the interactive doll 22 may be dressed as a police officer, a doctor, a lawyer, a firefighter, or the like. Interactive doll 22 may include ears 23, hands 24, face 25, hands 27, and a torso 28. In a suitable embodiment the ears 23 may be heart shaped. Ears 23 may be located proximal to said face 25. Ears 23 may be made of a soft material such as cotton, foam, fabric, or the like. Eyes 24 may be heart shaped for ornamental purposes. Eyes 24 may be located on said face 25. It should be understood that as the interactive doll 22 may have a substantially human shape, the doll may also include parts such as arms, legs, feet, shoulders, and the like.

The electrical assembly 40 includes ear sensors 41, nose sensor 42, hand sensors 43, a selector switch 44, a speaker 45 and a microprocessor 46. Each of the sensors (41, 42, 43) located inside the interactive doll 22 configure touch responsive zones which activate predetermined outputs from the microprocessor 46. The ear sensor 41 may be internally located in said ears 23 as depicted in FIG. 3. In a suitable embodiment the ear sensors 41 may be touch sensors, which captures a physical touch on a device and/or object. Touch sensor enables a device to detect touch or near proximity. In another embodiment the ear sensors 41 may be proximity sensors, capacitive touch sensors, resistive touch sensors, or other suitable sensors that are sensitive to touch, force, or pressure, as known in the art. The nose sensor 42 may be internally located in a nose of the interactive doll 22 as depicted in FIG. 3. In a suitable embodiment the nose sensor 42 may be touch sensors, which captures a physical touch on a device and/or object. In another embodiment the nose sensor 42 may be proximity sensors, capacitive touch sensors, resistive touch sensors, or other suitable sensors that are sensitive to touch, force, or pressure, as known in the art. The hand sensors 43 may be internally located in the hands of the interactive doll 22 as depicted in FIG. 5. In a suitable embodiment the hand sensors 43 may be touch sensors, which captures a physical touch on a device and/or object. In another embodiment the hand sensors 43 may be proximity sensors, capacitive touch sensors, resistive touch sensors, or other suitable sensors that are sensitive to touch, force, or pressure, as known in the art. The sensors (41, 42, 43) may be electrically connected with the microprocessor 46. The connection between sensors (41, 42, 43) and microprocessor 46 may be electric wires. Speaker 45 may be volumetrically suitable to be placed inside the interactive doll 22. The speaker 45 may be located inside the interactive doll's head. However, in other embodiments the speaker 45 may be located wheresoever inside the interactive doll 22. The speaker 45 may be an electric device used to convey predetermined audible messages. The speaker 45 may be electrically connected with the microprocessor 46. The connection between the speaker 45 and the microprocessor 46 may be electric wires. As depicted in FIG. 6 the selector switch 44 may be located on top of the interactive doll's head. The selector switch 44 may allow a user to select a predetermined configuration from predetermined options. Selector switch 44 may be electrically connected to the microprocessor 46. The connection between the selector switch 44 and the microprocessor 46 may be electric wires. The microprocessor 46 may have input ports to receive electric signals that the microprocessor 46 interprets. The sensors (41, 42, 43) and the selector switch 44 may be inputs for the microprocessor to execute predetermined functions. The speaker 45 may be electrically connected to an output of the microprocessor 46, meaning that the microprocessor 46 sends electric signals for the output devices (in this case the speaker 45) to execute predetermined tasks. In one embodiment when the ear sensor located on a left ear of the interactive doll detects pressure/touch/force, the sensor 46 sends an electric signal to the microprocessor 46. The microprocessor 46 acquires and interprets the signal sent by the sensor to then send an output signal to the speaker 45. The speaker 45 may convey predetermined audible message coming from the microprocessor 46. The selector switch 44 allows a user to select a predetermined language in which the audible messages may be conveyed. In a suitable embodiment, the selector switch 44 may allow a user to select one predetermined language out of 6 predetermined languages. The sensors located in the nose, the hands and in the right ear may send a signal to the microprocessor 45 to perform predetermined actions.

The actuation assembly 60 includes a rotation mechanism 62, a hug mechanism 64, and a smile mechanism 66. The mechanisms mentioned in the present assembly 60 are for the interactive doll 22 to perform physical motions. The rotation mechanism 62 may located inside the doll's head as shown in the FIG. 3. The rotation mechanism 62 may be connected to the face 25. Said face 25 may be movable. In a suitable embodiment the face 25 of the interactive doll 22 may have a rear mirror face 25*a*. In order to show the mirror face 25*a* the face may rotate 180° along a longitudinal axis. The rotation mechanism 62 may be connected to the face 25. In a suitable embodiment the rotation mechanism 62 may be a step motor which can be rotated a predetermined number of steps, wherein each step is a represents a predetermined degree that the motor's shaft rotates. A step motor may allow to rotate the face 180° to show the mirror face 25*a*. However, in other embodiments the rotation mechanism may be other suitable means that allow controlled rotation as known in the art. The nose sensor 42 may send an actuation signal to the microprocessor. The microprocessor 46 may receive the signal sent by the nose sensor to activate the rotation mechanism 62. When a user touches the nose of the interactive doll, the face 25 may rotate to show the mirror face 25*a* so the user can see their own face in the doll's body. FIG. 4 shows the mirror face 25*a* of the interactive doll 22. The hug mechanism 64 may be located inside the chest of the interactive doll 22. The hug mechanism may be internally attached to the arms of the interactive doll 22 as depicted in FIG. 7. To activate the hug mechanism a user may touch/press the hand sensors 43. When pressed the hand sensors 43 an activation signal from the sensors 43 may be sent to the microprocessor 46. The microprocessor 46 may be electrically connected to the hug mechanism 44. The microprocessor 46 may send an output signal to actuate the hug mechanism 64. When activated, the hug mechanism 64 allow both arms to be raised a predetermined distance in order to allow a user to hug the interactive doll 22. The smile mechanism 66 may be internally located in the dol's head. To actuate the smile mechanism 66 the user may touch the right ear, for the ear sensor 41 located in the right ear to send an actuation signal to the microprocessor 46. The smile mechanism 66 may be capable of receiving electrical signals. The microprocessor 46 may be electrically connected with the smile mechanism 66. The smile mechanism 66 may be connected with the mouth of the interactive doll 22. When a user touches the right ear of the interactive doll 22, the interactive doll smiles by means of the smile mechanism 66.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An interactive doll, comprising:

a) a doll assembly including an interactive doll, said interactive doll has a shape of a human figure, the interactive doll has touch responsive zones which activate speech outputs, the interactive doll further includes a face which is capable of being changed into a mirror face configured to reflect a user's face back to them;

b) an electrical assembly including sensors placed in predetermined zones of the interactive doll, said sensors allow the interactive doll to be touch responsive, the electrical assembly further includes a speaker to convey predetermined audible messages, a selector switch is included to select a predetermined language in which predetermined audible messages are conveyed; and c) an actuation assembly, said actuation assembly includes a rotation mechanism, a hug mechanism, and a smile mechanism, wherein said rotation mechanism, said hug mechanism, and said smile mechanism are capable of receiving electrical signals.

2. The interactive doll of claim 1, wherein said interactive doll is capable of being dressed as a nurse, as a doctor, as a lawyer, as a police officer, as a firefighter.

3. The interactive doll of claim 1, wherein said interactive doll further includes ears, wherein said ears are hart shaped.

4. The interactive doll of claim 1, wherein said interactive doll further includes eyes, said eyes are heart shaped.

5. The interactive doll of claim 1, wherein said electrical assembly includes sensors located in ears, a nose, and hands of the interactive doll.

6. The interactive doll of claim 5, wherein said sensors are sensitive to touch and/or pressure.

7. The interactive doll of claim 5, wherein said sensors, said speaker, and said selector switch are electrically connected with a microprocessor.

8. The interactive doll of claim 7, wherein said microprocessor receives and sends actuation signals to perform predetermined actions.

9. The interactive doll of claim 5, wherein when a sensor from the sensors located on a left ear of the interactive doll is actuated, the sensor sends a signal to the microprocessor, causing the microprocessor to send an output signal to the speaker for the speaker to convey a predetermined audible message.

10. The interactive doll of claim 5, wherein when a sensor from the sensors located on a left ear of the interactive doll is actuated, the sensor sends a signal to the microprocessor, by receiving a signal from the sensor located in the right ear the microprocessor sends an output signal to a smile mechanism make the interactive doll's face smile.

11. The interactive doll of claim 5, wherein when a sensor from the sensors located inside the nose of the interactive doll is actuated, the sensor sends a signal to the microprocessor, by receiving a signal from the sensor located inside the nose, the microprocessor sends an output signal to the rotation mechanism to change the face of the interactive doll into said mirror face.

12. The interactive doll of claim 1, wherein when a sensor from the sensors located on hands of the interactive doll are actuated, the sensors sends a signal to the microprocessor, by receiving a signal from the sensor located in a right ear the microprocessor sends an output signal to a hug mechanism, when actuated the hug mechanism which is internally connected to arms of the interactive doll, rises both arms for the interactive doll to be in hug configuration.

13. The interactive doll of claim 1, wherein said selector switch is electrically connected to the microprocessor, said microprocessor stores predetermined languages in which the messages are conveyed by the speaker.

14. An interactive doll, comprising:

a) a doll assembly including an interactive doll, said interactive doll has a shape of a human figure, the interactive doll has touch responsive zones which activate speech outputs, the interactive doll further includes a face which is capable of being changed into a mirror face configured to reflect a user's face back to them;

b) an electrical assembly including sensors placed inside hands, ears, and a nose of the interactive doll, said sensors are sensitive to touch, force and or pressure, the electrical assembly further includes a speaker to convey predetermined audible messages, a selector switch is included to select a predetermined language in which predetermined audible messages are conveyed, and a microprocessor, said microprocessor receives signals coming from the sensors, the microprocessor send actuation signals to perform predetermined actions; and c) an actuation mechanism including a rotation mechanism, a smile mechanism, and a hug mechanism, said rotation mechanism, the smile mechanism and the hug mechanism are capable of receiving electrical signals to actuate each of them, the rotation mechanism permits to change the face of the interactive doll into mirror face, the hug mechanism is internally connected to arms of the interactive doll, the hug mechanism allows the doll to raise the arms for the interactive doll to be in hug configuration, the smile mechanism is internally connected to a mouth of the interactive doll, the smile mechanism permits the mouth to be moved to give an appearance of smiling.

15. The interactive doll of claim 14, wherein said hug mechanism is actuated when the sensors located inside the hands of the interactive doll detects a touch, a force, or a pressure.

16. The interactive doll of claim 14, wherein said rotation mechanism is actuated when the sensor located inside the nose of the interactive doll detects a touch, a force, or a pressure.

17. The interactive doll of claim 14, wherein said smile mechanism is actuated when the sensor located on a right ear of the interactive doll detects a touch, a force, or a pressure.

18. An interactive doll, consisting of:

a) a doll assembly including an interactive doll, said interactive doll has a shape of a human figure, the interactive doll has touch responsive zones which activate speech outputs, the interactive doll further includes a face which is capable of being changed into a mirror face configured to reflect a user's face back to them;

b) an electrical assembly including sensors placed inside hands, ears, and a nose of the interactive doll, said sensors are sensitive to touch, the electrical assembly further includes a speaker to convey predetermined audible messages, a selector switch is included to select a predetermined language in which predetermined audible messages are conveyed, and a microprocessor, said microprocessor receives signals coming from the sensors, the microprocessor send actuation signals to perform predetermined actions;

c) an actuation mechanism including a rotation mechanism, a smile mechanism, and a hug mechanism, said rotation mechanism, the smile mechanism and the hug mechanism are capable of receiving electrical signals to actuate each of them, the rotation mechanism permits to change the face of the interactive doll into mirror face, the hug mechanism is internally connected to arms of the interactive doll, the hug mechanism allows the doll to raise the arms for the interactive doll to be in hug configuration, the smile mechanism is internally connected to a mouth of the interactive doll, the smile mechanism permits the mouth to be moved to give an appearance of smiling; and d) said hug mechanism is actuated when the sensors located inside the hands of the interactive doll detects a touch, said rotation mechanism is actuated when the sensor located inside the nose of the interactive doll detects a touch, said smile mechanism is actuated when the sensor located on a right ear of the interactive doll detects a touch, a force, or a pressure, when a sensor from the sensors located inside the left ear of the interactive doll, the speaker conveys a predetermined audible message.

* * * * *